US006470955B1

(12) United States Patent
Richard et al.

(10) Patent No.: US 6,470,955 B1
(45) Date of Patent: Oct. 29, 2002

(54) SEMI-SOLID CASTING APPARATUS AND METHOD

(75) Inventors: Kevin L. Richard, Evansville, IN (US); Richard I. Neill, Jr., Henderson, KY (US); Christopher S. Rice, Cambridge, MA (US); Shinya Myojin, Somerville, MA (US); Patricio F. Mendez, Cambridge, MA (US); Timothy B. Gage, Henderson, KY (US); John F. O'Daniels, Henderson, KY (US); Charles E. Barron, Marion, KY (US)

(73) Assignee: Gibbs Die Casting Aluminum Co., Henderson, KY (US)

( * ) Notice: Subject to any disclaimer, the term of this patent is extended or adjusted under 35 U.S.C. 154(b) by 0 days.

(21) Appl. No.: 09/359,247

(22) Filed: Jul. 22, 1999

Related U.S. Application Data

(60) Provisional application No. 60/094,108, filed on Jul. 24, 1998, and provisional application No. 60/124,734, filed on Mar. 17, 1999.

(51) Int. Cl.[7] ..... B22D 1/00; B22D 17/08

(52) U.S. Cl. ..... 164/113; 164/900; 164/71.1; 222/595; 222/593

(58) Field of Search ..... 164/113, 312, 164/309, 900, 133, 136, 71.1, 335, 337; 222/595, 593; 266/239

(56) References Cited

U.S. PATENT DOCUMENTS

| | | | |
|---|---|---|---|
| 3,157,923 | A | 11/1964 | Hodler |
| 3,222,776 | A | 12/1965 | Kawecki |
| 3,528,478 | A | 9/1970 | Koch et al. |
| 3,791,876 | A | 2/1974 | Kroger |
| 3,902,544 | A | 9/1975 | Flemings et al. |
| 3,907,192 | A | 9/1975 | Grietens |
| 3,920,223 | A | 11/1975 | Krueger |
| 3,932,980 | A | 1/1976 | Mizutani et al. |
| 3,936,298 | A | 2/1976 | Mehrabian et al. |
| 3,948,650 | A | 4/1976 | Flemings et al. |
| 3,951,651 | A | 4/1976 | Mehrabian et al. |
| 3,954,455 | A | 5/1976 | Flemings et al. |

(List continued on next page.)

FOREIGN PATENT DOCUMENTS

| | | |
|---|---|---|
| DE | 2320761 | 11/1974 |
| EP | 0 476 843 B1 | 3/1992 |
| EP | O 657 235 A1 | 6/1995 |

(List continued on next page.)

OTHER PUBLICATIONS

Die Casting Partially Solidified High Copper Content Alloys, Fascetta, E.F., Riek, R.G., Mehrabian, R., and Flemings, M.C. "Cast Metals Research Journal", vol. 9, No. 4, Dec. 1973, pp 167–171.

(List continued on next page.)

*Primary Examiner*—M. Alexandra Elve
*Assistant Examiner*—I.-H. Lin
(74) *Attorney, Agent, or Firm*—Barnes & Thornburg

(57) ABSTRACT

A die casting system includes a vessel defining a reservoir with a controlled heater and an agitator for maintaining the bath of semi-solid metal in a homogeneous isothermal state, a transfer system capable of transferring a known quantity of metal in its semi-solid state to a mold cavity in a die casting machine, the transfer system including a heated suction tube, a vacuum source for vacuum ladling semi-solid metal from the bath to a die, and a plunger tip providing a path for free air flow to allow evacuation of the suction tube during casting and a metal replacement system for replacing the known quantity of transferred metal with a similar amount of liquid metal so that a stable homogeneous isothermal bath of semi-solid metal is controllably maintained to be available for die casting operations.

6 Claims, 10 Drawing Sheets

U.S. PATENT DOCUMENTS 3,955,802 A 5/1976 de Bruyne
3,979,026 A 9/1976 Lee
3,993,290 A 11/1976 Kovich
4,008,883 A 2/1977 Zubieta
4,049,204 A 9/1977 McKee
4,065,105 A 12/1977 Lussiez et al.
4,072,543 A 2/1978 Coldren et al.
4,089,680 A 5/1978 Flemings et al.
4,108,643 A 8/1978 Flemings et al.
4,116,423 A 9/1978 Bennett
4,124,307 A 11/1978 Anisic
4,194,552 A 3/1980 Bennett
4,215,628 A 8/1980 Dodd, Jr.
4,229,210 A 10/1980 Winter et al.
4,231,664 A 11/1980 Flock
4,278,355 A 7/1981 Forberg
4,305,673 A 12/1981 Herbst
4,310,124 A 1/1982 Schwing et al.
4,310,352 A 1/1982 Manfre et al.
4,345,637 A 8/1982 Flemings et al.
4,347,889 A 9/1982 Komatsu et al.
4,361,404 A 11/1982 Colin et al.
4,373,950 A 2/1983 Shingu et al.
4,382,685 A 5/1983 Pearson
4,390,285 A 6/1983 Durr et al.
4,397,687 A 8/1983 Bye
4,434,837 A 3/1984 Winter et al.
4,436,429 A 3/1984 Strong et al.
4,453,829 A 6/1984 Althouse, III
4,457,355 A 7/1984 Winter et al.
4,469,444 A 9/1984 Gmeiner et al.
4,482,012 A 11/1984 Young et al.
4,506,982 A 3/1985 Smithers et al.
4,534,657 A 8/1985 Clement
4,565,241 A 1/1986 Young
4,565,242 A 1/1986 Yano et al.
4,577,676 A 3/1986 Watson
4,580,616 A 4/1986 Watts
4,620,795 A 11/1986 Diebold et al.
4,635,706 A 1/1987 Behrens
4,687,042 A 8/1987 Young
4,694,881 A 9/1987 Busk
4,694,882 A 9/1987 Busk
4,709,746 A 12/1987 Young et al.
4,771,818 A 9/1988 Kenney
4,775,239 A 10/1988 Martinek et al.
4,799,801 A 1/1989 Bruning
4,799,862 A 1/1989 Davidson et al.
4,804,034 A 2/1989 Leatham et al.
4,865,808 A 9/1989 Ichikawa et al.
4,874,471 A 10/1989 Wilmotte
4,893,941 A 1/1990 Wayte
4,926,924 A 5/1990 Brooks et al.
4,958,678 A 9/1990 Kawamura et al.
4,964,455 A 10/1990 Meyer
4,972,899 A 11/1990 Tungatt
5,009,844 A 4/1991 Laxmanan
5,037,209 A 8/1991 Wyss
5,085,512 A 2/1992 Doman
5,110,547 A 5/1992 Kiuchi et al.
5,121,329 A 6/1992 Crump
5,135,564 A 8/1992 Fujikawa et al.
5,144,998 A 9/1992 Hirai et al.
5,161,601 A 11/1992 Abis et al.
5,161,888 A 11/1992 Hauck
5,178,204 A 1/1993 Kelly et al.
5,186,236 A 2/1993 Gabathuler et al.
5,211,216 A 5/1993 Drury et al.
5,219,018 A 6/1993 Meyer
5,253,696 A 10/1993 Misra
5,257,657 A 11/1993 Gore
5,271,539 A * 12/1993 Ozawa et al. ..... 164/309
5,287,719 A 2/1994 Moritaka et al.
5,313,815 A 5/1994 Nichting et al.
5,342,124 A 8/1994 Swisher, Jr.
5,343,926 A 9/1994 Cheskis et al.
5,375,645 A 12/1994 Brueker et al.
5,381,847 A 1/1995 Ashok et al.
5,388,633 A 2/1995 Mercer, II et al.
5,411,330 A 5/1995 Arutyunov et al.
5,464,053 A 11/1995 Moschini
5,478,148 A 12/1995 Thomas et al.
5,492,166 A * 2/1996 Liu et al. ..... 164/312
5,701,942 A 12/1997 Adachi et al.
5,775,403 A 7/1998 Premkumar et al.
5,836,372 A 11/1998 Kono
5,881,796 A * 3/1999 Brown et al. ..... 164/113
5,887,640 A 3/1999 Brown et al.
5,913,353 A 6/1999 Riley et al.

FOREIGN PATENT DOCUMENTS

EP 0 719 606 A1 7/1996
EP 0 761 344 A2 3/1997
EP 0 765 945 A1 4/1997
JP 62-50065 3/1987
JP 63-199016 8/1988
JP 0306047 12/1989
JP 1-313141 12/1989
JP 1-313164 12/1989
SU 732073 5/1980
WO WO 87/06624 11/1987
WO WO 95/34393 12/1995
WO WO 97/12709 4/1997

OTHER PUBLICATIONS

"Rheocasting and Thixocasting—A Review of Progress To Date," J. Campbell and M. Met, 138 Foundry Trade Journal 3037, 291–295, Feb. 20,1975.

Rheocasting Processes, Flemings, M.C., Riek, R.G., and Young, K. P. "International Cast Metals Journal", vol. 1, No. 3, Sep. 1976, pp. 11–22.

"Stirring Action Opens Up Steel Die Casting," David A. Van Cleave, Iron Age, 34–35, Aug. 22, 1977.

"Thixotropic Process Casts High Performance Aluminum Parts," Modern Metals, 26H–26L, Jan. 1993.

Overview of SST/Gibbs Semi–Solid Process, "Semi–Solid Tehcnologies, Gibbs Die Casting", SAE Exposition, Feb. 1998.

Thesis: "The Machine Casting of High Temperature Semi–Solid Materials," by Danial G. Backman, Massachusetts Institute of Technology, Sep., 1975.

"A World Wide Assessment of Rapid Prototyping Technologies," RF Aubin United Technologies Research Center Report No. 94–13, dated Jan. 1997, 29 pages.

*H.L. Marcus and D.L. Bourell, "Solid Freeform Fabrication," Advanced Materials & Processes, dated Sep. 1993, pp. 28–31 and 34–35.

J.W. Comb and W.R. Priedeman, Stratasys, Inc., "Control Parameters and Materials Criteria for Rapid Prototyping Systems," copyright date 1993, pp. 86–93.

Stratasys, Inc., "Rapid Prototyping Using FDM: A Fast, Precise, Safe Technology," paper from the Solid Freeform Fabrication Symposium, Aug. 3–5, 1992, pp. 301–308.

R.E. Reed–Hill and R. Abbashian, Physical Metallurgy Principles, PWK–Kent Publishing Company, 1992, pp. 325–349.

M.E. Orme, K. Willis and J. Courter, Department of Mechanical and Aerospace Engineering, University of California–Irvine, "The Development of Rapid Prototyping of Metallic Components Via Ultra–Uniform Droplet Deposition," undated, pp. 27–36.

J.W. Comb , W.R. Priedeman and P.W. Turley, Stratasys, Inc., "Control Parameters and Material Selection Criteria for Fused Deposition Modeling," undated, pp. 163–170.

M.C. Flemings and K.P. Young, $9^{th}$ SDCE International Die Casting Exposition and Congress, Jun. 6–9, 1977, "Thixocasting of Steel," Paper No. G–T77–092, dated Jun. 6–9, 1977, 8 pages.

S.B. Brown and M.C. Flemings, "Net–Shape Forming Via Semi–Solid Processing," Advanced Materials & Processess, dated Jan. 1993, pp. 36–40.

* cited by examiner

SEMI-SOLID CASTING APPARATUS AND METHOD

CROSS REFERENCE TO RELATED APPLICATION

This application claims the benefit of U.S. provisional application Ser. No. 60/094,108 filed on Jul. 24, 1998 and U.S. provisional application Ser. No. 60/124,734 filed on Mar. 17, 1999.

FIELD OF THE INVENTION

This invention relates to casting of components from semi-solid metals and more particularly to casting components from semi-solid metal removed from a bath of semi-solid metal.

BACKGROUND OF THE INVENTION

Manufacturers of metallic components have long recognized the advantages of die casting components which are adaptable to fabrication by that process. The advantages of die casting components from semi-solid (or thixotropic) metals are also well documented and include, but are not limited to, the creation of finished heat-treatable components that are less porous and exhibit a more homogeneous structure than components cast from molten metal.

Reference is made to a number of prior art references as follows:

U.S. Patents

1. U.S. Pat. No. 4,709,746, Process and Apparatus for Continuous Slurry Casting, to Young et al.
2. U.S. Pat. No. 5,313,815, Apparatus and Method for Producing Shaped Metal Parts Using Continuous Heating to Nichting et al.
3. U.S. Pat. No. 4,565,241, Process for Preparing a Slurry Structured Metal Composition, to Young.
4. U.S. Pat. No. 5,464,053, Process for Producing Rheocast Ingots, Particularly From which To Produce High-Mechanical-Performance Die Castings, to Moschini.
5. U.S. Pat. No. 5,381,847, Vertical Casting Process, to Ashok et al.
6. U.S. Pat. No. 5,375,645, Apparatus and Process for Producing Shaped Articles From Semisolid Metal Preforms, to Breuker et al.
7. U.S. Pat. No. 5,287,719, Method of Forming Semi-Solidified Metal Composition, to Moritaka et al.
8. U.S. Pat. No. 5,219,018, Method of Producing Thixotropic Metallic Products by Continuous Casting. With Polyphase Current Electromagnetic Agitation, to Meyer.
9. U.S. Pat. No. 5,178,204, Method and Apparatus for Rheocasting, to Kelly et al.
10. U.S. Pat. No. 5,110,547, Process and Apparatus for the Production of Semi-solidified Metal Composition, to Kiuchi et al.
11. U.S. Pat. No. 4,964,455, Method of Producing Thixotropic Metallic Products by Continuous Casting, to Meyer.
12. U.S. Pat. No. 4,874,471, Device for Casting a Metal in the Pasty Phase, to Wilmotte.
13. U.S. Pat. No. 4,804,034, Method of Manufacture of a Thixotropic Deposit, to Leathham et al.
14. U.S. Pat. No. 4,687,042, Method of Producing Shaped Metal Parts, to Young.

15. U.S. Pat. No. 4,580,616, Method and Apparatus for Controlled Solidification of Metals, to Watts.
16. U.S. Pat. No. 4,345,637, Method for Forming High Fraction Solid Compositions by Die Casting, to Flemings et al.
17. U.S. Pat. No. 4,108,643, Method for Forming High Fraction Solid Metal Compositions and Composition Therefor, to Flemings et al.
18. U.S. Pat. No. 3,902,544, Continuous Process for Forming an Alloy Containing Non-Dendritic Primary Solids, to Flemings et al.
19. U.S. Pat. No. 5,211,216, Casting Process, to Drury et al.
20. U.S. Pat. No. 3,948,650, Composition and Methods for Preparing Liquid-Solid Alloys for Casting and Casting Methods Employing the Liquid-Solid Alloys, to Flemings et al.
21. U.S. Pat. No. 3,954,455, Liquid-Solid Alloy Composition, to Flemings et al.
22. U.S. Pat. No. 4,972,899, Method and Apparatus for Casting Grain Refined Ingots, to Tungatt.
23. U.S. Pat. No. 4,577,676, Method and Apparatus for Casting Ingot with Refined Grain Structure, to Watson.
24. U.S. Pat. No. 4,231,664, Method and Apparatus for Combined High Speed Horizontal and High Speed Vertical Mixing of Chemically Bonded Foundry Sand, to Flock.
25. U.S. Pat. No. 4,506,982, Apparatus for Blending Viscous Liquids With Particulate Solids, to Smithers et al.
26. U.S. Pat. No. 4,469,444, Mixing and Degassing Apparatus for Viscous Substances, to Gmeiner et al.
27. U.S. Pat. No. 5,037,209, Apparatus for the Mixing of Fluids, in Particular. Pasty Media and a Process for its Operation, to Wyss.
28. U.S. Pat. No. 4,893,941, Apparatus for Mixing Viscous Liquids in a Container, to Wayte.
29. U.S. Pat. No. 4,397,687, Mixing Device and Method for Mixing Molten Metals, to Bye.

Related Articles

30. Rheocasting Processes, Flemings, M. C., Riek, R. G., and Young, K. P. "International Cast Metals Journal", vol. 1, No. 3, September 1976, pp. 11–22.
31. Die Casting Partially Solidified High Copper Content Alloys, Fascetta, E. F., Riek, R. G., Mehrabian, R., and Flemings, M. C. "Cast Metals Research Journal", Vol. 9, No. 4, December 1973, pp. 167–171.

The above references teach the general concepts involved and benefits of forming metallic components from semi-solid metals. The references also teach the standard techniques used for die casting in general and for die casting components from semi-solid metal. Also included are references teaching various methods of stirring and agitating semi-solid materials. All of the references, and the references cited therein, are incorporated herein for purpose of establishing the methods and procedures available for processing semi-solid metals and die casting components and methods.

Most previous methods and devices for die casting components from semi-solid metals used cylindrical slugs cut from solid bars, or billets, preformed with a semi-solid microstructure. These billets were heated to cause them to return to a semi-solid state prior to being forced under extremely high pressure (typically on the order of 16,000–30,000 psi (2.32–4.35 Pa)) into casting molds. These billets are susceptible to surface oxidation allowing oxidized material to be incorporated into the final component. Also, this process requires that metal be heated to a semi-solid state, the billet be cast and cooled, inventoried, cut to length, possibly shipped, and finally reheated prior to casting of the final component.

The present invention provides a device and method whereby a bath of stable, constantly agitated, temperature controlled, semi-solid metal is maintained in a reservoir and delivered in its original semi-solid state to a die casting machine ready for immediate casting into a final component. The transfer may be accomplished through a heated suction tube and temperature controlled charge sleeve by vacuum ladling. The semi-solid metal being transferred is pressed into the die cavity by a plunger tip providing a vent path to break the vacuum formed during ladling to allow semi-solid metal in the suction tube to return to the bath during the pressing process. Thus a readily available bath of stable, homogenous, temperature controlled semi-solid metal is provided in a die-casting environment which may be delivered on demand in its semi-solid form to mold cavities of die-casting presses for fabrication of metallic components with enhanced performance characteristics.

According to the present invention an apparatus for delivering heated metal to a die casting device having at least one cavity, a vacuum gate, and a metal feed gate includes a source of molten metal maintained at a predetermined temperature range above the temperature at which it will begin to solidify, a vessel containing the metal in a semi-solid state wherein up to about 45% of the metal is suspended as particles in a fluid fraction of the metal, a heated suction tube, a shot sleeve in metal flow communication with the vessel through the heated suction tube and also in communication with the cavity through the metal feed gate, a plunger reciprocally disposed in the sleeve to force semi-solid metal in the sleeve under pressure into the cavity, and a vacuum source communicating with the vacuum gate, cavity, feed gate and shot sleeve to draw semi-solid metal from the temperature controlled vessel through the heated suction tube into the sleeve in a position to be forced by the plunger into the die. The vessel includes a bottom, a side wall, and a top, and the apparatus may include an agitator disposed in the vessel and a heater positioned to deliver heat to semi-solid metal in the vessel through the bottom of the vessel. The bottom of the vessel may include an independently dimensioned heating chamber in metal flow communication with the semi-solid metal in the vessel through the bottom of the vessel and the heater may be positioned to heat metal in the heating chamber. The heater may be an induction heater. The agitator may be positioned in the vessel to promote mixing of metal in the heating chamber with the semi-solid metal in the vessel. The shot sleeve may be jacketed and a fluid may be circulated through the jacket. The apparatus may include a delivery means for delivering predetermined volumes of molten metal from the source of molten metal to the vessel. The suction tube for delivering the semi-solid metal to the heated shot sleeve may extend upwardly from the surface of semi-solid metal in the vessel.

According to another aspect of the present invention, an improved vessel for holding and maintaining a semi-solid metal in an isothermal state for use in casting includes a bottom, side wall, and top, an agitator, and a heater located to deliver heat to the semi-solid metal in the vessel through the bottom of the vessel. The bottom of the vessel may include an independently dimensioned heating chamber in metal flow communication with semi-solid metal in the vessel through the bottom of the vessel with the heater positioned to heat metal in the heater chamber. The heater may be an induction heater. The vessel may include an agitator positioned to promote mixing of metal in the heating chamber with the stirred semi-solid metal in the vessel.

According to yet another aspect of the invention a die casting process wherein a semi-solid metal is driven from a charge sleeve by a plunger into a die is improved by including the step of heating the charge sleeve. The charge sleeve may be jacketed and a fluid may be circulated through the jacket.

According to another aspect of the invention, a method for die casting metal alloy from a source of alloy maintained in a semi-solid state includes the steps of providing a die casting press having a mold cavity for receiving the metal to be cast and chilling the metal to a solid form, providing a vessel of molten metal having a bottom and a side, lowering the temperature of the molten metal to a level at which the metal will begin to solidify, stirring the metal and controlling the temperature to maintain the metal at an isothermal state containing solid particles of metal and molten metal, wherein controlling the temperature is accomplished by heating through the bottom of the vessel and wherein cooling of the metal is in part through the side of the vessel, and wherein the stirring includes shearing of solidifying metal from the sides of the vessel, whereby the metal in the vessel is maintained in a stable semi-solid condition with constant stirring and temperature control. The step of periodically withdrawing controlled amounts of metal from the vessel and transferring the metal to the mold cavity for casting through a suction tube may be included. The temperature of the withdrawn metal may be controlled during the transferring step. Controlled amounts of molten metal may be periodically added to the vessel to replace each withdrawn amount of metal. The metal suspended in the suction tube may be allowed to return to the bath during casting of a component.

According to yet another aspect of the present invention an apparatus for delivering heated metal to a die casting device having at least a pair of dies forming at least one cavity therebetween, a vacuum gate, and a metal feed gate for the manufacture of molded metal castings includes a vessel having temperature control mechanisms and agitators for holding a reservoir of semi-solid metal, a system for delivering molten metal to the vessel, a transfer system to deliver semi-solid metal from the vessel to the die cast mold in the semi-solid state, and a heating chamber in fluid communication with the vessel. The apparatus may include regulators for controlling the amount of semi-solid metal withdrawn from the vessel and the amount of molten metal added to the vessel. The transfer system may include mechanical ladling or vacuum ladling and may also include a suction tube with a heater. The apparatus may include a suction tube in fluid communication with a shot sleeve and a plunger which seals the shot sleeve during vacuum ladling to allow semi-solid metal to be drawn into the shot sleeve and suspended in the suction tube prior to pressing the material into the mold cavity and which creates a vent path during the pressing process allowing metal previously suspended in the suction tube to return to the metal bath. The apparatus may also include an induction heater for heating metal within the heating chamber. The vessel may have a volume substantially greater than the volume of semi-solid metal required to fabricate a component by die casting.

According to the present invention, an apparatus for delivering heated metal to a die casting device having at least a pair of dies forming at least one cavity therebetween, a vacuum gate, and a metal feed gate for the manufacture of molded metal castings includes a vessel for holding a reservoir of semi-solid metal, a suction tube in fluid communication with the reservoir, and a charge sleeve in fluid communication with the cavity and the suction tube. The charge sleeve includes an aperture in which the suction tube is received to form a junction, the aperture is formed to reduce the surface area of the charge sleeve in the junction. The suction tube may include a beveled end received in the aperture. The suction tube may be non-metallic. The charge sleeve may include a countersink formed in the aperture.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

FIG. 7 is a partial cross-sectional view of the suction tube, charge sleeve, and plunger tip of the present invention showing the plunger sealing the charge sleeve to the right of the suction tube junction allowing the vacuum source (not shown) in fluid communication with the left end of the charge sleeve to draw semi-solid metal from the bath through the suction tube and into the charge sleeve.

FIG. 8 is a partial cross-sectional view similar to FIG. 7 showing the plunger moved to the left in the charge sleeve to begin pressing semi-solid metal into the die (not shown) and showing the semi-solid metal still filling the suction tube because the plunger still seals the right end of the charge sleeve so that the vacuum applied in FIG. 7 is still present.

FIG. 9 is a partial cross-sectional view similar to FIG. 8 showing the plunger moved farther to the left so that air is flowing past the plunger through the channel formed by the channel wall of the plunger and the charge sleeve and into the suction tube breaking the vacuum formed in FIG. 7 so that the semi-solid metal in the suction tube is falling back into the semi-solid bath.

FIG. 10 is a partial cross-sectional view similar to FIG. 9 showing the plunger moved even farther to the left indicating that sufficient time has passed since the breaking of the vacuum holding the semi-solid metal in suction tube so that all semi-solid metal previously suspended in the suction tube has returned to the bath and evacuated the suction tube.

DESCRIPTION OF THE PREFERRED EMBODIMENTS

Figure 1:
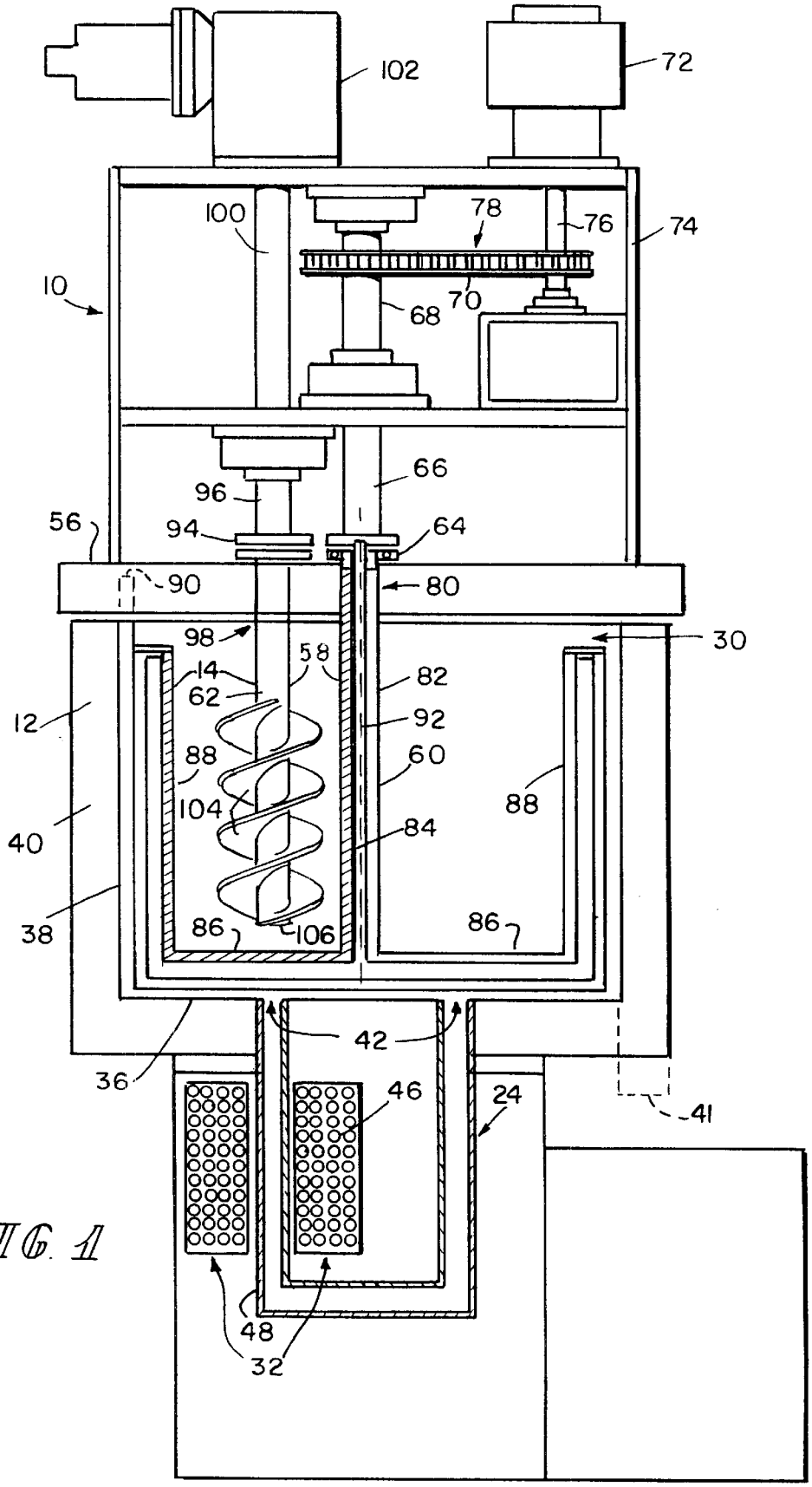
FIG. 1 is a partial schematic view of an empty device for providing a bath of constantly agitated, temperature controlled, semi-solid metal which may be delivered in its original semi-solid state to a die-casting machine ready for immediate casting into a final component in accordance with the present invention.
Figure 2:
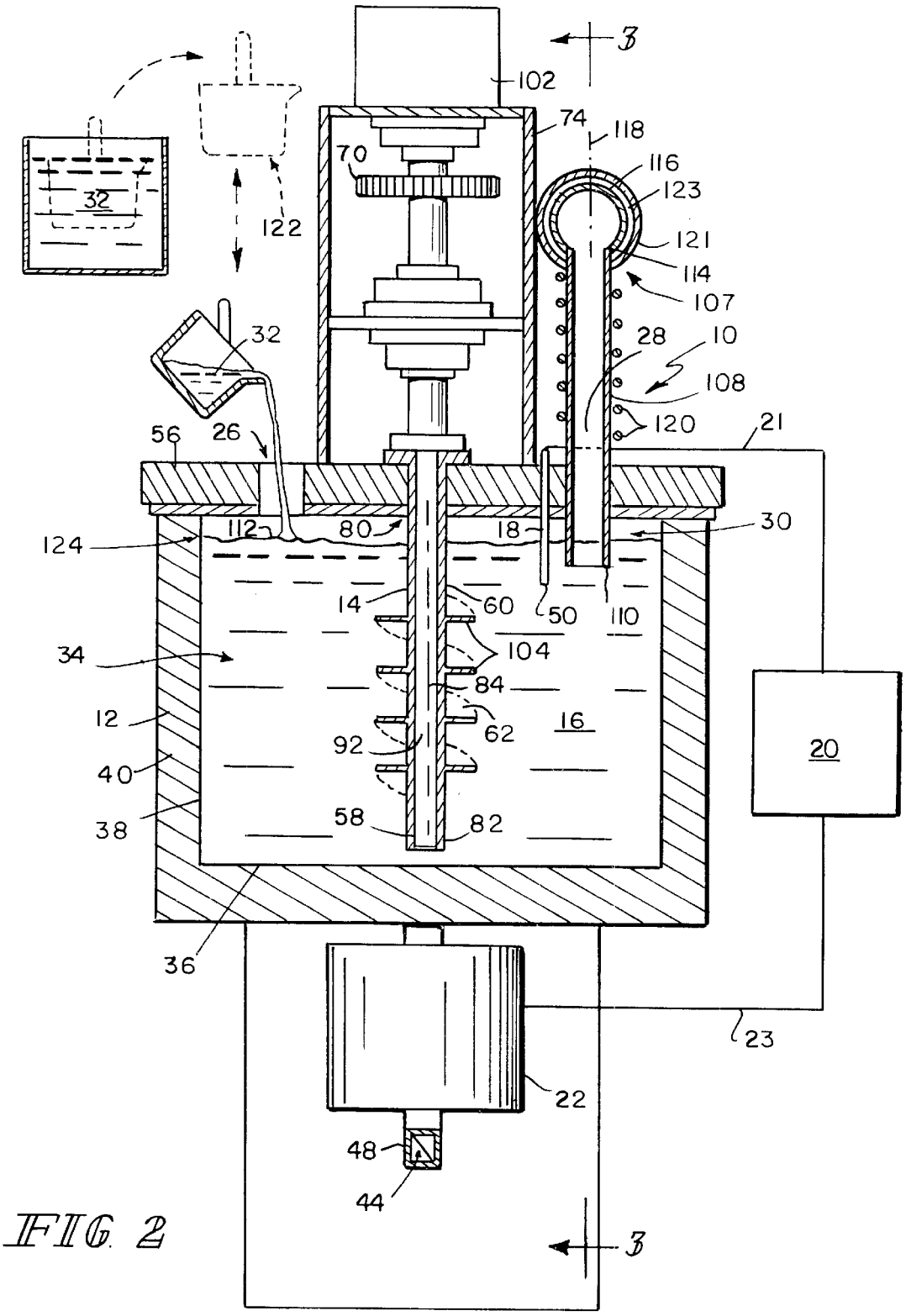
FIG. 2 is a partial cross-section of a first embodiment of the present invention showing a heating chamber located below and in fluid communication with a vessel having a reservoir filled with the bath of agitated, temperature controlled, semi-solid metal and a heated suction tube and a charge sleeve for delivery of the metal in its semi-solid state to a die casting machine for immediate casting into a final component.
Figure 3:
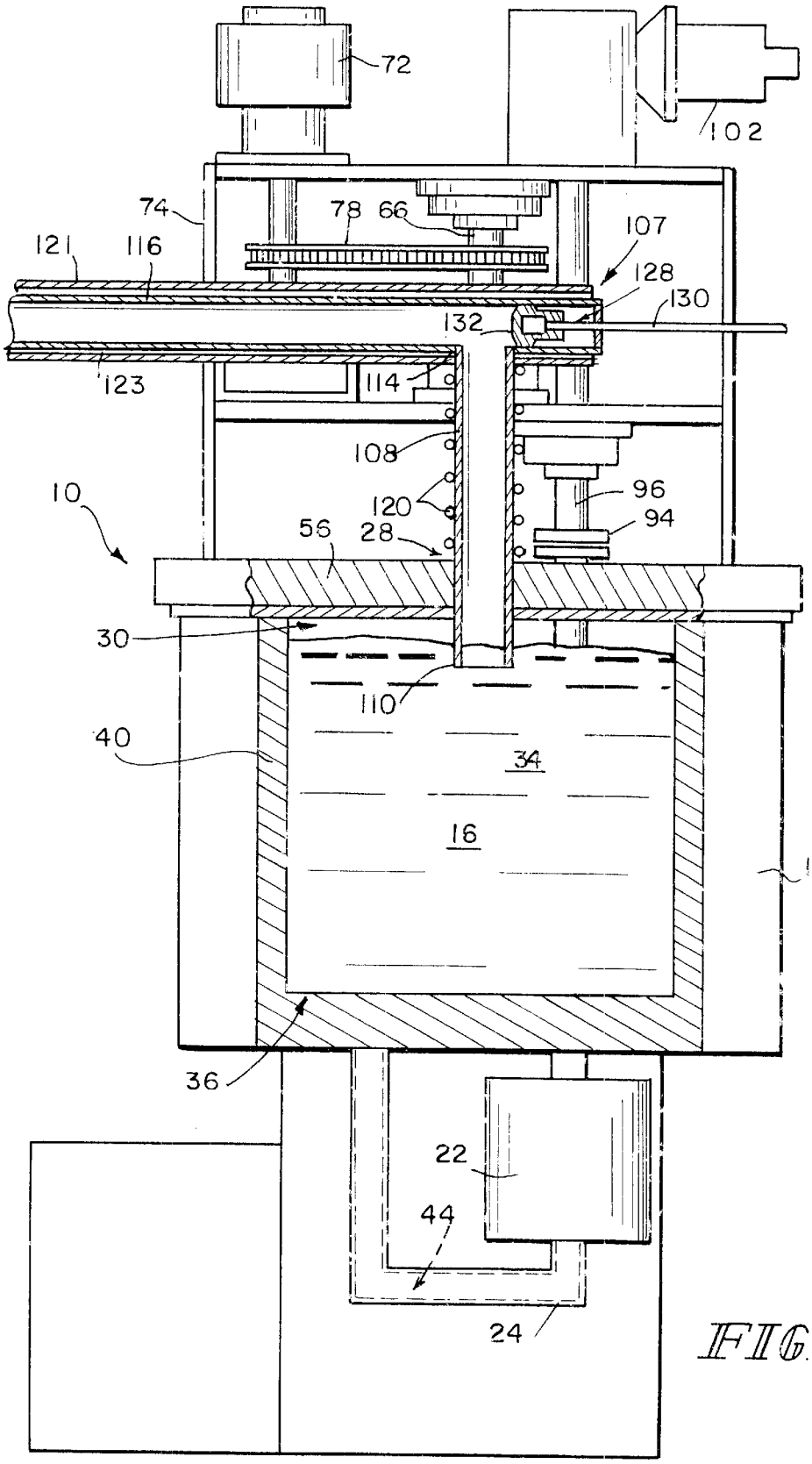
FIG. 3 is a partial cross-section taken along line 3—3 of FIG. 2 showing the heated suction tube extending between the semi-solid bath and the charge sleeve and also showing a plunger disposed for reciprocal movement in the charge sleeve.

While the invention is adaptable for use with any metal or alloy which can be maintained in a semi-solid state, the disclosed device is specifically configured for use with aluminum alloys, especially Aluminum A356. Referring to FIGS. 1–3, a semi-solid metal furnace 10 for use in die casting components contains vessel 12 designed to control heat loss of metals held therein. Vessel 12 contains agitation system 14 for mixing and inhibiting dendrite formation within semi-solid metal bath 16 held within vessel 12. Sensor 18 (FIG. 2) disposed within vessel 12 communicates information related to the solid fraction of semi-solid metal bath 16 to controller 20 for heater 22. Heater 22 is thermally connected to heating chamber 24 which is in fluid communication with vessel 12. Inlet 26 and outlet 28 in fluid communication with reservoir 30 through top 56 provide access to reservoir 30 for addition of molten metal 32 to, and removal of semi-solid metal 34 from, semi-solid metal bath 16. Semi-solid metal furnace 10 is located in a die-casting environment in proximity to die-casting machine (not shown) so that semi-solid metal 34 is readily available to, and deliverable in its semi-solid state to a mold cavity (not shown) of the die-casting machine.

Vessel 12 has bottom wall 36 and cylindrical side wall 38 which, along with top 56, define reservoir 30 within which semi-solid metal 34 may be stored in a semi-solid metal bath 16 as shown, for example, in FIG. 2. Vessel 12 is formed to meet design specifications which facilitate controlling heat loss from the semi-solid metal bath 16 through cylindrical side walls 38, bottom wall 36, and top 56. When A356 is to be contained in vessel 12, vessel side wall 38, bottom wall 36, and top 56 include a refractory wall 40 made of Therm bond Formula Five-L having a thickness 41 of approximately 2.5 inches (6.35 cm). At this thickness 41 side wall 38, bottom wall 36, and top 56 dissipate heat from semi-solid metal bath 16 but prevent heat from dissipating at a rate greater than the rate that heater 22 is capable of heating semi-solid metal bath 16. Illustratively, heater 22 is a 35 kW induction heater and vessel 12 is designed so heat dissipation through side wall 38, bottom wall 36, and top 56 is less than 35 kW. Induction heater 22 is of the type commonly available from Ajax Magnathermic. It is envisioned that by controlling the rate at which semi-solid metal 34 is withdrawn and replaced with molten metal 32, heat dissipation through side wall 38, bottom 36, and top 56 of vessel 12 may exceed the heating capacity of induction heater 22. When other metals are to be maintained in a semi-solid state for casting operations, side wall 38, bottom wall 36, and top 56 should be fabricated from appropriate materials having a thickness 41 sufficient to ensure that the heat loss through side wall 38, bottom wall 36, and top 56 does not exceed the heat which may be provided to semi-solid bath 16 by heater 22 and by addition of molten metal 32 to replace withdrawn semi-solid metal 34.

Heating chamber 24 is in fluid communication with reservoir 30 through apertures 42 in bottom wall 36 of vessel 12. Heating chamber 24 is made from refractory tubing formed to define a U-shaped channel 44 extending downwardly from vessel 12 with core 46 of inductive heater 22 wrapped around one side of U-shaped channel 44 of heating chamber 24 to heat heating chamber 24 as shown, for example, in FIGS. 1–3. Induction core 46 of induction heater 22 creates a field is which induces heating of semi-solid metal 34 contained in heating chamber 24.

Illustratively, sensor 18 is a thermocouple 50. The solid fraction of semi-solid metal bath 16 is related to the temperature of bath 16. However, sensor 18 may be any device capable of determining any characteristic of semi-solid metal bath 16 or furnace 10 operation which is related to the solid fraction of semi-solid metal bath 16 and providing a signal to heater controller 20 based on the value of the determined characteristic. Some characteristics of furnace 10 operation which are believed to be related to the solid fraction of semi-solid metal bath 16 are the torque experienced by the motors 72, 102 driving the rotor 60 or auger 62, and the vibration of the rotor shaft 66 or auger shaft 96. Thus sensor 18 may be a torque transducer, or an optical device sensitive to vibration. Illustratively, sensor 18 is electrically coupled to heater controller 20. Heater controller 20 is connected by wiring 23 to heater 22. Controller 20 may be a P.I.D. controller appropriately programmed to maintain the temperature of semi-solid metal bath 16 at the setpoint.

Thermocouple 50 extends through top 56 of vessel 12, is partially submerged in semi-solid metal bath 16, and is connected to heater controller 20 which selectively activates and deactivates heater 22 to regulate the temperature of semi-solid metal bath 16. For A356 aluminum alloy, the temperature of semi-solid metal bath 16 is regulated to within one degree Celsius (1° C.) (1.8° F.) of a setpoint between 590° C. (1094° F.) and 615° C. (1139° F.) (the "setpoint"). When furnace 10 is used with metals other than A356 the setpoint is selected within a temperature range within which the metal assumes a semi-solid state.

For A356, source 52 of molten metal 32 is maintained slightly above 615° C.(1139° F.), i.e. the liquidation temperature of the metal to be formed into semi-solid metal 34. Molten metal 32 from source 52 may be manually or automatically ladled by ladle 54 into inlet 26 as shown by phantom lines 53 in FIG. 2. It is envisioned that appropriate fluid communication could be formed between source 52 and inlet 26 with appropriate valves to automatically control the flow of molten metal 32 between source 52 and reservoir 30.

During initial start up, molten metal 32 from source 52 is used to fill reservoir 30. Heat is dissipated through cylindrical side wall 38 of vessel 12 until molten metal 32 begins to solidify. Semi-solid metal 34 is produced in vessel 12 as the temperature of metal bath 16 cools down from that of molten metal 32 to the setpoint.

Illustratively, agitation system 14 constantly agitates semi-solid metal bath 16 in reservoir 30 and is believed to inhibit dendrite formation and formation of a temperature gradient within bath 16 during solidification. This constant agitation also promotes homogeneity throughout semi-solid metal bath 16 within reservoir 30 by removing excess metal that solidifies at side wall 38 and sending this excess metal into the bulk of bath 16. During solidification, dendritic structures or dendrites form in metal 34. Breaking of the dendritic structure is referred to as shearing dendrites. Thus, the constant agitation shears dendrites from side wall 38 of vessel 12 as will be described hereafter. Two separate agitators 58 are disposed within vessel 12 and are designed to constantly agitate semi-solid metal bath 16 within reservoir 30. Both agitators 58 mix semi-solid metal 34 to some extent. Illustratively, agitators 58 include a central rotor 60 and an auger 62. However, central rotor 60 performs the bulk of the shearing action and horizontal mixing, while auger 62 performs the bulk of the vertical mixing.

Central rotor 60 is connected to drive end 64 of shaft 66 which is connected at driven end 68 to a sprocket (obscured). Motor 72, mounted to frame 74 of furnace 10 is connected to drive shaft 76 which is drivably connected to shaft 66 by reduction gears (obscured) and chain 70. Any standard arrangement for coupling motor 72 to central rotor 60 capable of maintaining the desired angular velocity of central rotor 60 may be used such as pulleys and belts, intermeshing gears and the like. Coupling 78 between motor 72 and central rotor 60 is preferably designed and arranged to rotate central rotor 60 with an angular velocity of twenty-five to thirty-five revolutions per minute (25–35 rpm).

Central rotor 60 extends through concentric void 80 in top 56 of vessel 12 so that central member 82 lies on and rotates about longitudinal axis 84 of cylindrical wall 38 of vessel 12. Bottom legs 86 of central rotor 60 extend from central member 82 toward side wall 38 of vessel 12 adjacent to bottom wall 36 of vessel 12. Side legs 88 of central rotor 60 extend upwardly from bottom legs 86 adjacent to cylindrical side wall 38 of vessel 12. In order to shear dendrites which tend to form during solidification, which first occurs along cylindrical wall 38 of vessel 12, bottom legs 86 and side legs 88 of central rotor 60 are preferably disposed to rotate within less than one inch (1.0") (2.54 cm) of cylindrical side wall 38 and bottom wall 36 of vessel 12. Since cooling of semi-solid metal bath 16 primarily occurs by heat transfer through side wall 38 and bottom wall 36, and heating of semi-solid metal bath 16 primarily occurs by heat transfer through fluid communication between the reservoir 30 and heating chamber 24, the displacement of side legs 88 from side wall 38 and the displacement of bottom leg 86 from bottom wall 36 are both important. The displacement of side legs 88 from side wall 38 and the displacement of bottom leg 86 from bottom wall 36 are referred to as wall clearance 90. The shear rate of central rotor 60 is based upon wall clearance 90 and angular velocity of central rotor 60.

While central rotor 60 may be solid titanium or stainless steel, it may also be formed from hollow stainless steel or titanium material forming an internal fluid channel 92. It has been found that certain metals, especially aluminum alloys, can have deleterious effects on stainless steel which has been submerged in a bath 16 of semi-solid metal 34 for substantial periods. To reduce the deleterious effects, central rotor 60 may be cooled by connecting fluid channel 92 to a source of cooling fluids such as air, oil, water or the like (not shown). While the processes reducing the deleterious effects are not fully understood, it is believed that semi-solid metal 34 in bath 16 immediately solidifies on contact with cooled central rotor 60 to form a coating (not shown) on central rotor 60 of solidified metal. It is believed that this coating reduces the deleterious effects of having central rotor 60 constantly submerged in semi-solid metal bath 16. It is also believed that once central rotor 60 is coated to a sufficient thickness, a temperature gradient is created in the coating metal so that the difference between the temperature of the outside surface of the coating metal and semi-solid metal bath 16 is insufficient to induce further coating.

Auger 62 is directly connected at auger end 94 of drive shaft 96 which extends through off-center bore 98 in top 56 and is connected at drive end 100 to bidirectional variable speed motor 102 mounted to frame 74 of furnace 10. Bidirectional variable speed motor 102 is designed to rotate auger 62 with an angular velocity of between 100–200 rpm. In the illustrated device, counter-clockwise rotation of auger 62 (looking down from top) causes blades 104 to force any adjacent semi-solid metal 34 downwardly toward bottom wall 36 of vessel 12, while clockwise rotation of auger 62 causes blades 104 to force any adjacent semi-solid metal 34 upwardly toward top 56 of vessel 12. To prevent suspended solidified metal in semi-solid metal bath 16 from settling to bottom 36 of vessel 12, auger 62 is operated in the clockwise direction. Thus, settling solidified metal is pulled from bottom 36 to maintain the homogenous nature of semi-solid metal bath 16 in reservoir 30. Bottom 106 of auger 62 is located adjacent to aperture 42 in bottom wall 36 opening into heating chamber 24. Therefore, rotation of auger 62 also induces flow of semi-solid metal 34 into and out of heating chamber 24. The described auger 62 is exemplary and other stirring or mixing devices may be used. For instance, very good results have been obtained with a multiple bladed mixing device.

Constant agitation of semi-solid metal bath 16 and rapid replacement of removed semi-solid metal 34 with molten metal 32 slightly above the liquidation temperature creates a sustainable homogeneous, isothermal, semi-solid metal bath 16 contained in reservoir 30 from which casting charges may be withdrawn as needed. When using A356, disclosed furnace 10 maintains a semi-solid metal bath 16 having up to 45% solid metal in a fluid fraction of metal at within one degree Celsius (1° C.) (1.8° F.) of the setpoint for delivery to a casting machine. In illustrated furnace 10 which uses vacuum ladling in transfer system 107, it is preferable to maintain the percentage of solid material suspended in the fluid fraction of metal at or below 30%. If transfer system includes hand or mechanical ladling, it is believed that higher solid fractions may be used. The particles of solid metal in suspension are limited in size to 100–500 micrometers (0.0254–0.127") and are fairly uniformly distributed throughout semi-solid metal bath 16.

Suction tube 108 includes a top end 114, a pickup end 110, and a longitudinal axis 118. Suction tube 108 extends through top 56 of vessel 12 with pickup end 110 disposed below surface 112 of semi-solid bath 16. Top end 114 of suction tube 108 is in fluid communication with charge sleeve 116. Longitudinal axis 118 of suction tube 108 is preferably oriented vertically to inhibit solidification of semi-solid metal 34 within suction tube 108. Suction tube 108 is also heated by controlled heater 120 which maintains the temperature of suction tube 108 at greater than 600° C. (1112° F.) to prevent solidification of semi-solid metal 34 within suction tube 108.

Suction tube 108 is connected to charge sleeve 116 containing a plunger 128 reciprocally disposed therein. Charge sleeve 116 connects to metal feed gate (not shown) to be in fluid communication with cavity (not shown) formed by at least a pair of dies (not shown) having a vacuum gate (not shown). Jacket 121 encases charge sleeve 116 and is designed to receive fluid 123, such as oil, maintained at approximately 150° C. (302° F.) to prevent excessive heating or cooling of charge sleeve 116. Since it is envisioned that semi-solid metal 34 will only be present in charge sleeve 116 for a short period of time, on the order of one tenth (1/10) of a second, the temperature differential between charge sleeve 116 and semi-solid metal 34 will not be sufficient to solidify metal.

Figure 11:
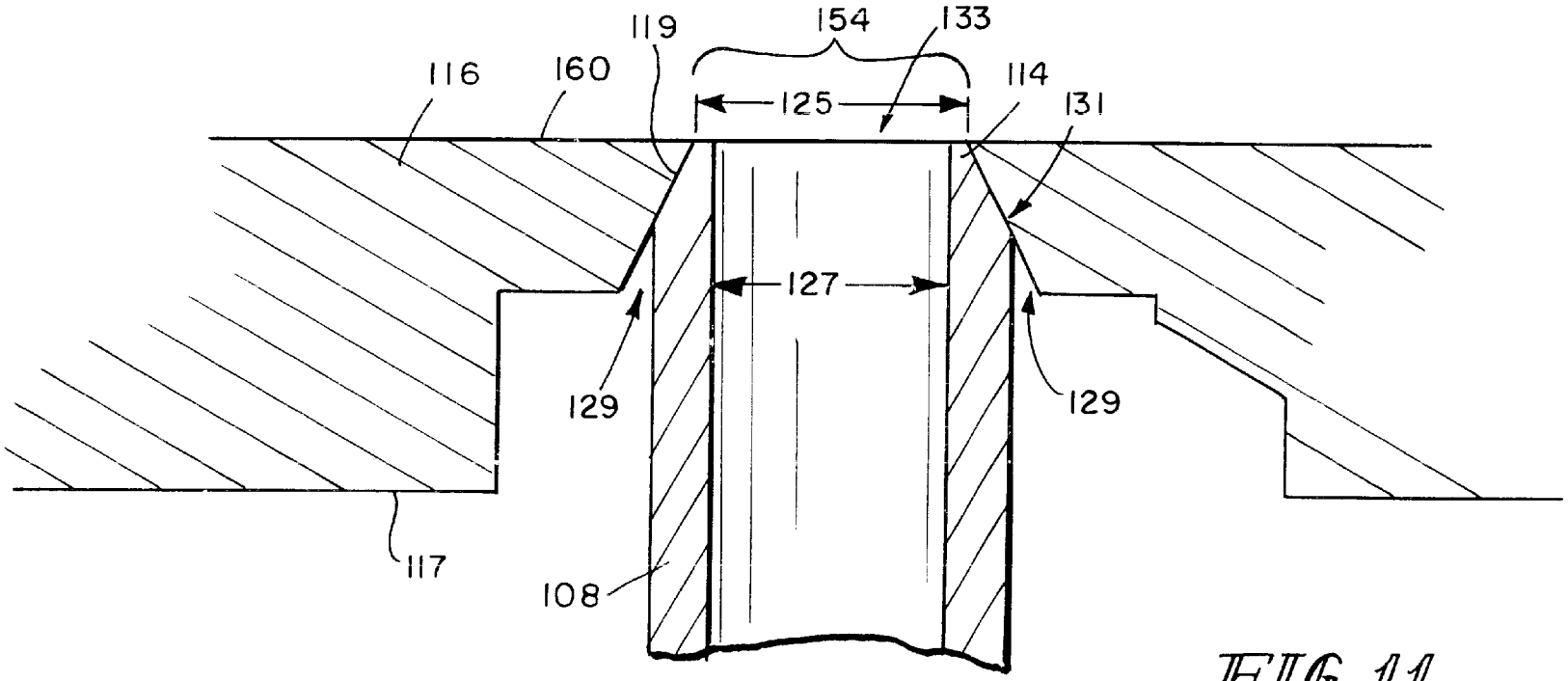
FIG. 11 is a partial cross sectional view of the junction between heated suction tube and heated charge sleeve showing a countersink in an aperture formed in the charge sleeve in which a beveled end of the suction tube is received to minimize the surface area of the charge sleeve in the area of the junction that could come in contact with the semi-solid metal during transfer.

Illustratively, charge sleeve 116 is a tube as is suction tube 108. Suction tube 108 is heated to a much higher temperature than charge sleeve 116 because semi-solid metal 34 being vacuum ladled to die cavity is prone to solidify at junction 154 of charge sleeve 116 and suction tube 108 where semi-solid metal 34 first contacts charge sleeve 116. Charge sleeve 116 has a wall 115 having an outside wall 117, an inside wall 160, and a junction wall 119 extending between outside wall 117 and inside wall 160 to define a junction aperture 133, as shown, for example, in FIG. 11. Solidification of semi-solid metal 34 at junction 154 is minimized by reducing the surface area of junction wall 119 into which semi-solid metal may come into contact. Junction aperture 133 is formed to have a diameter 125 approximately equal to inside diameter 127 of suction tube 108. A deep countersink 129 is formed in external surface 117 at junction wall 119 and top end 114 of suction tube 108 is formed to include a bevel 131 to be received in countersink 129, as shown, for example, in FIG. 11.

Metal feed gate provides for delivery of semi-solid metal 34 into cavity. A vacuum source (not shown) in communication with vacuum gate, cavity, metal feed gate, charge sleeve 116, and suction tube 108 provides sufficient pressure differential to quickly draw semi-solid metal 34 from semi-solid metal bath 16 through suction tube 108 and into charge sleeve 116. Plunger 128 is connected to a cylinder (not shown) so that after semi-solid metal 34 is received in charge sleeve 116, plunger 128 forces semi-solid metal 34 under pressure through metal feed gate to fill cavity. In illustrated furnace 10, semi-solid metal 34 delivered to charge sleeve is less than 30% solid particles so plunger 128 is only required to force semi-solid metal 34 into cavity at 5,000–13,000 psi (0.725–1.885 Pa.). When furnace 10 is operated to maintain a semi-solid bath 16 having 25% solid particles, plunger 128 forces semi-solid metal 34 into cavity at 6,000 psi. (0.87 Pa). Since dies and plunger 128 are subjected to less pressure than is encountered in the billet technique (i.e. 16,000–30,000 psi. (2.32–4.35 Pa.)), plunger 128 and die life may be extended by the present invention.

Plunger 128 includes a ram 130 and a plunger tip 132. Plunger tip 132 includes a front wall 134, a circumferentially extending seal wall 136 having a diameter 138 only slightly less than inside diameter 140 of charge sleeve 116, and a circumferentially extending channel wall 142 having a diameter 144 less than diameter 138 of seal wall 136 and diameter 140 of charge sleeve 116.

Seal wall 136 extends from front wall 134 rearwardly for a distance 146 to step 148 separating channel wall 142 from seal wall 136. Plunger tip 132, like standard plunger tips used in diecasting environment available from Semco, Inc., Pattern No. 869-D5, is manufactured from heat treated beryllium copper. Plunger tip 132 differs from these standard plunger tips in that standard plunger tips typically do not include a step 148 and a circumferentially extending channel wall 142. Plunger tip 132 may be manufactured from a standard plunger tip by appropriately machining a standard plunger tip on a lathe, boring complex, or the like to form step 148 and channel wall 142. Plunger tip 132 includes an inner chamber 150 in fluid communication with a temperature controlled fluid such as air, oil, water, coolant, or the like which can control the temperature of plunger tip 132.

Figure 8:
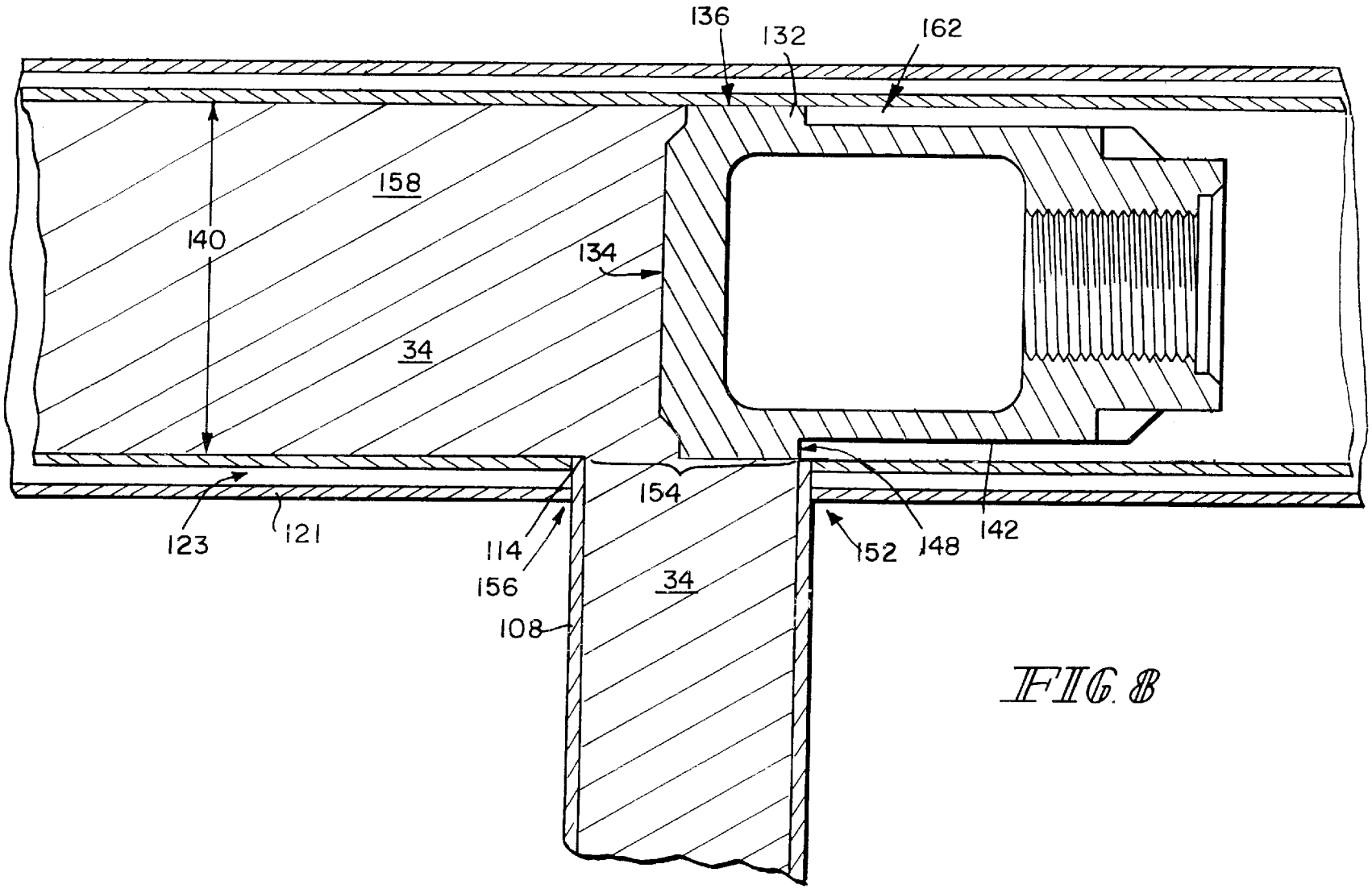

Plunger tip 132 is reciprocally received in charge sleeve 116 as shown, for example, in FIGS. 7–10. Prior to pressing semi-solid material 34 received in charge sleeve 116 into the cavity of a diecast machine, plunger 132 is positioned on opposite side 152 of junction 154 of charge sleeve 116 and suction tube 108 from side 156 of junction 154 on which a vacuum source (not shown) is located as shown, for example, in FIG. 7. Thus, seal wall 136 seals charge sleeve 116 to define a fluid path 158 between the diecast mold (not shown) and semi-solid bath 16. Vacuum source can draw semi-solid material 34 up through suction tube 108 and through charge sleeve 116 into mold cavity (not shown). When vacuum source (not shown) no longer supplies a vacuum, fluid path 158 remains sealed and semi-solid material 34 remains in charge sleeve 116 and suction tube 108 in preparation for pressing into the mold cavity. Ram 130 then begins to push plunger tip 132 toward the mold cavity as shown in FIG. 8. In FIG. 8, step 148 has not yet crossed opposite side 152 of junction 154 so seal wall 136 continues to seal charge sleeve 116. Because fluid path 158 remains sealed, semi-solid material 34 in suction tube 108 remains suspended in suction tube 108 under the influence of the previously applied vacuum.

Figure 9:
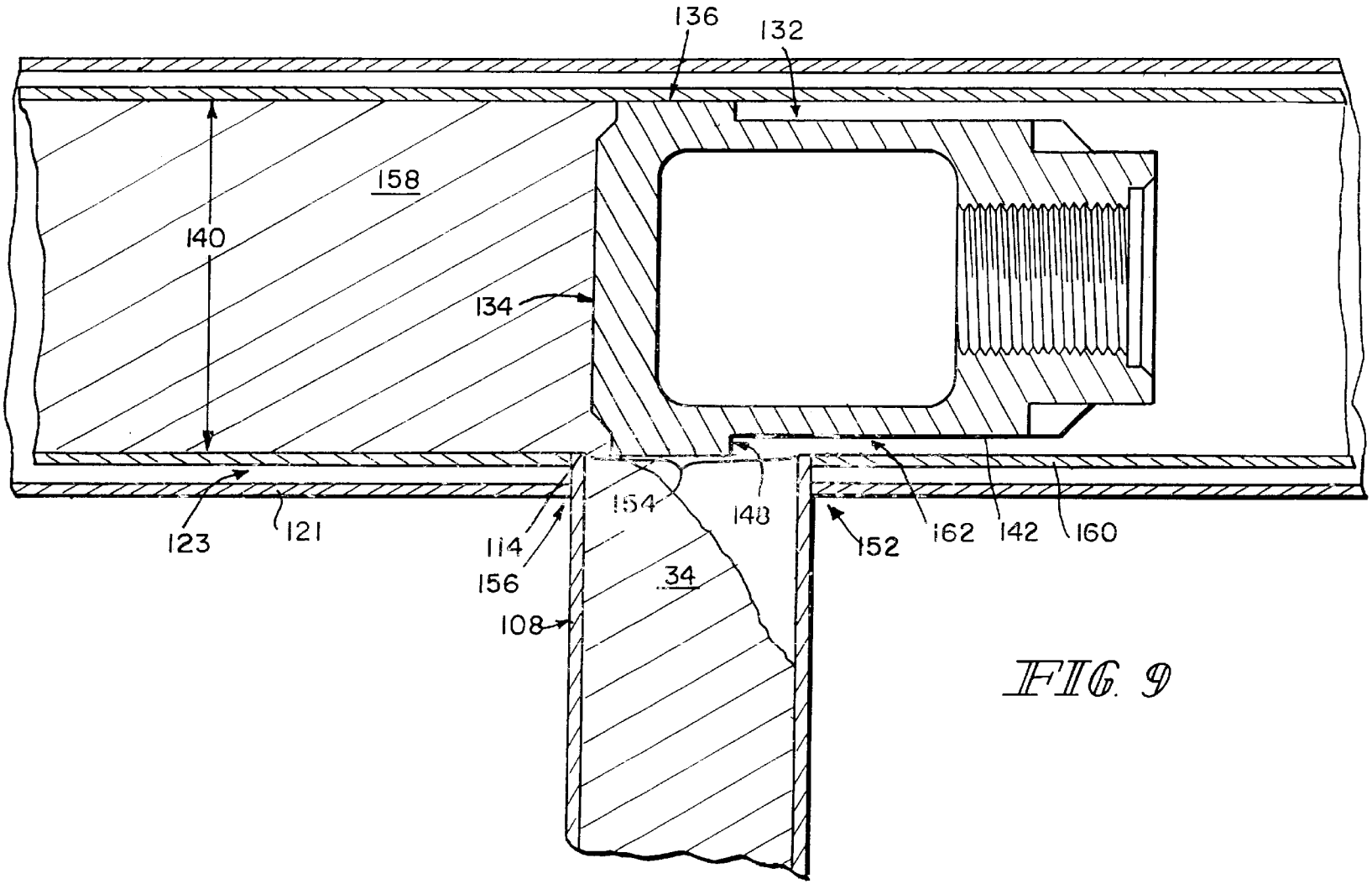
Figure 10:
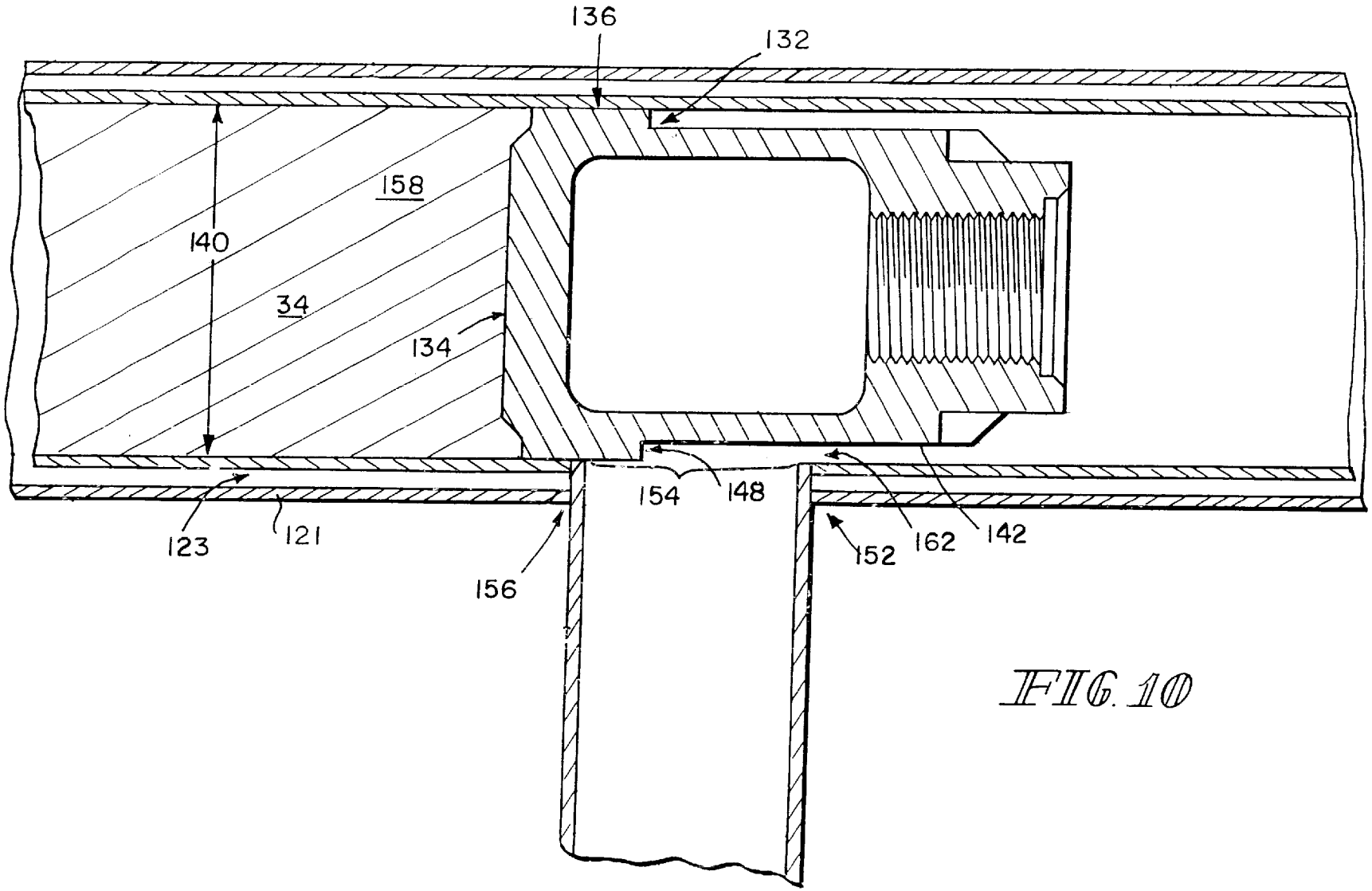

When plunger tip 132 has moved so that step 148 is between sides 152 and 156 of junction 154, seal wall 136 no longer seals fluid path 158 and channel wall 142 and inside wall 160 of charge sleeve 116 define a vent path or air channel 162 breaking the vacuum and allowing semi-solid metal 34 in suction tube 108 to begin to fall under the force of gravity back into semi-solid bath 16, as shown in FIG. 9. As plunger tip 132 travels farther to the left air channel 162 increases in size and all semi-solid metal 34 previously suspended in suction tube 108 eventually returns under the force of gravity to semi-solid bath 16 as shown, for example, in FIG. 10. It should be understood that plunger tip 132 continues to move farther to the left and press semi-solid metal 34 into mold cavity (not shown). After the semi-solid metal 34 in charge sleeve 116 is pressed into the mold cavity, metal feed gate is closed and plunger tip 132 is returned to the position it occupied in FIG.7 in preparation for the next casting cycle. Prior to application of low pressure by vacuum source to initiate vacuum ladling, the device assumes the state substantially as depicted in FIG. 3.

Configuration of plunger tip 132 not only provides an air passage 162 to break the seal holding semi-solid metal 34 in suction tube 108 but also minimizes the contact between semi-solid metal 34 and the cool beryllium copper material of plunger tip 132. Thus, the configuration of plunger tip 132 aids in maintaining the homogenous isothermal nature of semi-solid material 34 in suction tube 108 and charge sleeve 116. While illustrated plunger tip 132 includes a circumferentially extending channel wall 142, it should be understood that channel wall 142 need not extend circumferentially about tip 132 but may be formed as a longitudinal groove or the like so long as tip is oriented to cause channel wall 142 to break the seal holding semi-solid metal 34 in suction tube 108 and minimize contact between semi-solid metal 34 and the cool beryllium copper material of plunger tip 132. When semi-solid metal 34 is held in suction tube 108 and charge sleeve 116 for a short time, a standard plunger tip may be used in the present invention so long as the stroke of ram 130 is long enough that the rear edge of the standard plunger passes opposite side 152 of junction 154 and a path for air is formed to allow semi-solid metal 34 suspended in suction tube 108 to return to semi-solid metal bath 16.

Figure 4:
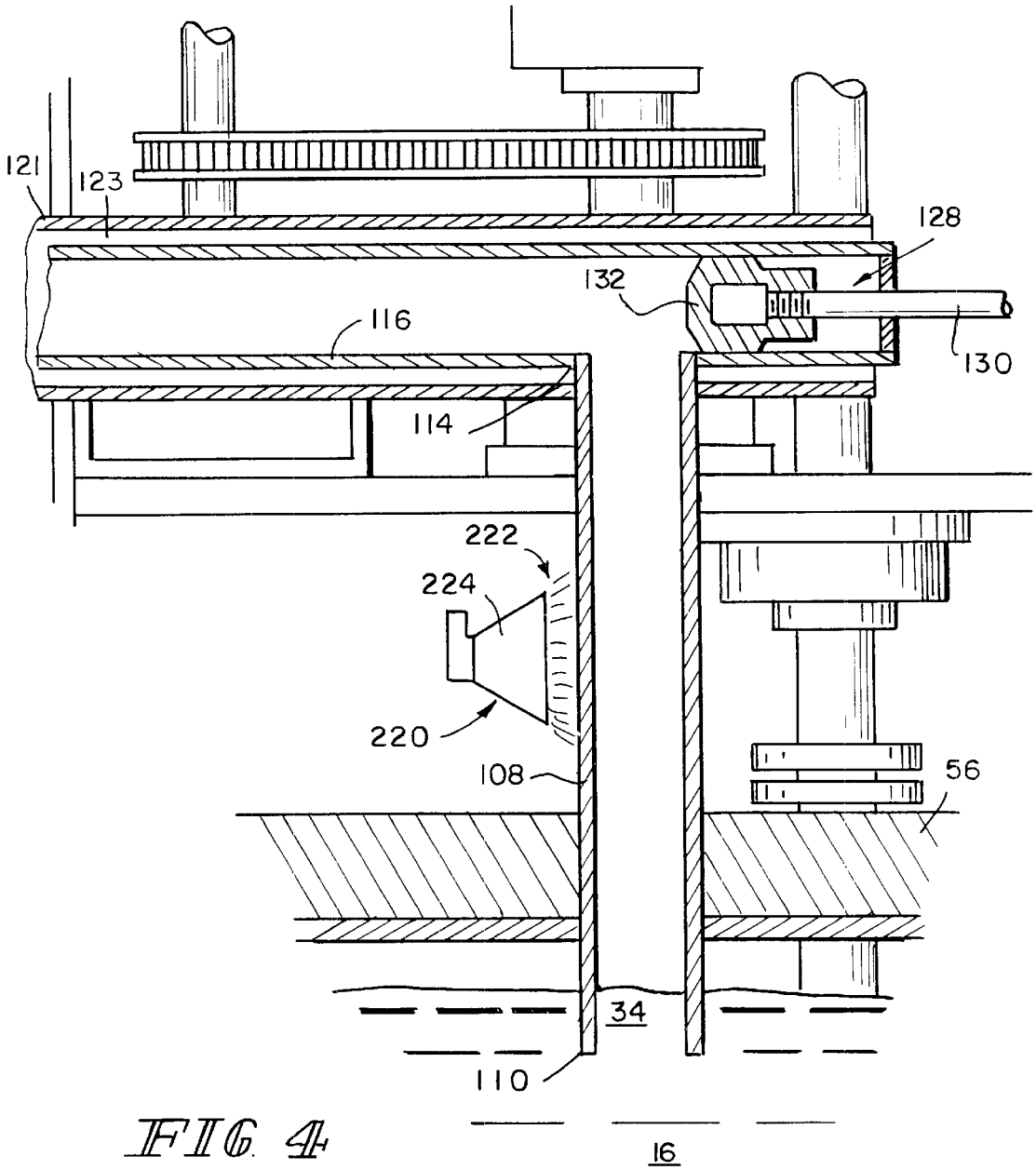
FIG. 4 is a close-up partial cross-sectional view of the suction tube, charge sleeve, and plunger substantially similar to FIG. 3 with an alternative gas flame heater heating the suction tube.
Figure 5:
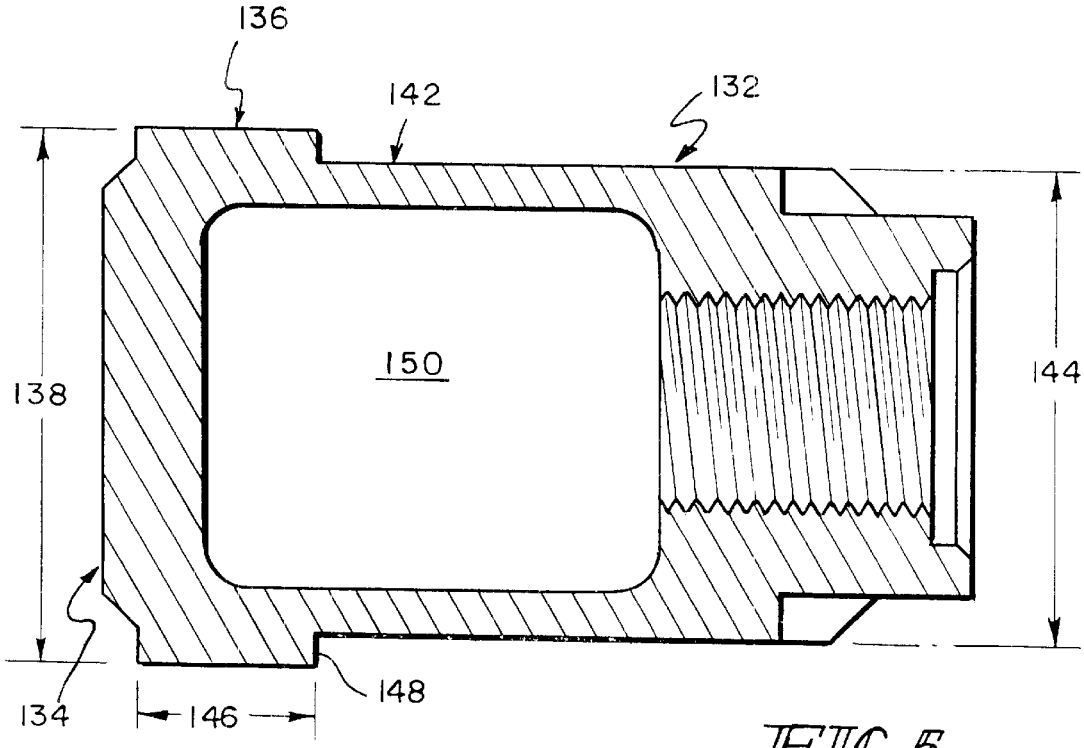
FIG. 5 is a cross-sectional view of the plunger tip of FIGS. 3 and 4 showing a larger diameter charge sleeve seal wall and a smaller diameter channel wall designed to minimize semi-solid metal contact with the plunger tip and to allow semi-solid metal in the suction tube to return to the semi-solid bath during the pressing and casting operations.
Figure 6:
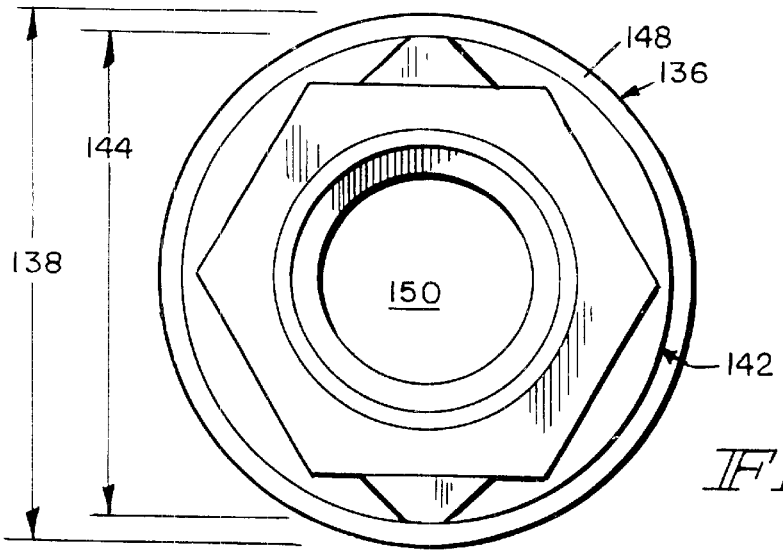
FIG. 6 is a side view of the plunger of FIG. 5.
Figure 7:
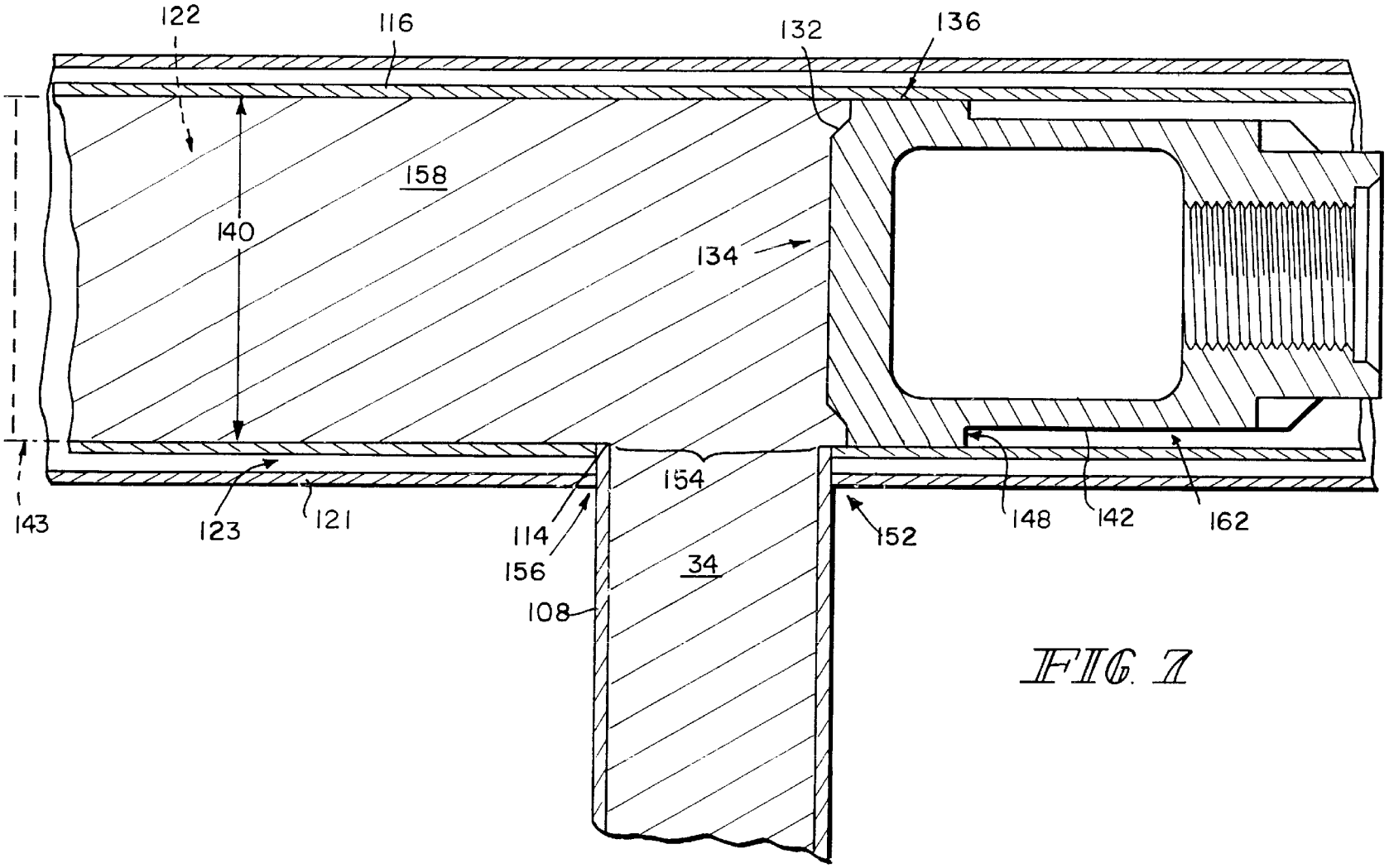
FIGS. 7–10 illustrate the process of rapidly pressing the semi-solid metal, which has been vacuum ladled previously into the charge sleeve, into a mold cavity (not shown).

Referring to FIG. 4, a second embodiment of suction tube 108 and heater 220 is shown. While FIGS. 2 and 3 illustrate an electric heater 120 using coils to heat suction tube 108, in the second embodiment, as shown, for example, in FIG. 4, suction tube 108 is heated by flames 222 from a blow torch or gas outlet 224. It is also within the scope of the invention to heat suction tube 108 with a combination of electric heaters 120, gas outlets 224, and/or other heaters.

In the presently preferred embodiment, suction tube 108 is manufactured from graphite which provides for more even heating of suction tube 108. As previously mentioned, suction tube 108 is heated to inhibit solidification of semi-solid metal 34 within suction tube 108. In the presently preferred embodiment, suction tube 108 is heated by both an electric heater 120 and gas outlets 224. Lower end of suction tube 108 is submerged in semi-solid bath 116 and is therefore substantially at the temperature of semi-solid bath 116. Approximately six inches (6") (15.24 cm) above lower end, suction tube 108 is heated by an electric heater 120 to approximately 790° C. (1450° F.). Flames 222 from gas outlet 224 heat the portion of suction tube 108 above the portion of suction tube 108 heated by electric heater 120. It should be understood that the temperature at different locations along suction tube 108 may vary so long as suction tube 108 is sufficiently heated to allow semi-solid metal 34 to return to bath 16 from suction tube 108 after plunger passes junction 154.

In fabrication of die cast parts, the amount of semi-solid metal 34 removed from semi-solid metal bath 16 through suction tube 108 into charge sleeve 116 is controlled. This may be controlled by controlling the duty cycle of the vacuum source so that the pressure differential is applied for a specified duration. Therefore, with each molding a known amount 122 of semi-solid metal 34 is removed from semi-solid bath 16. This known amount 122 is the volume of the mold cavity represented diagrammatically by dotted line 143 to the left of FIG. 7 and the portion of charge sleeve 116 on cavity side 156 of suction tube junction 154, as shown, for example, in FIG. 7. When known amount 122 of semi-solid metal 34 is removed from semi-solid metal bath 16 through suction tube 108, a like quantity 126 of molten metal 32 is added to semi-solid metal bath 16 from source 52 through inlet 26 to maintain level 124 of semi-solid metal bath 16 in reservoir 30 and the temperature of semi-solid metal bath 16. Like quantity 126 of molten metal 32 is preferably substantially equal to known amount 122 of removed semi-solid metal 34. While known quantity 122 of removed semi-solid metal 34 may be replaced after each casting cycle with a like quantity 126 of molten metal 32, it is often preferable to replace the cumulative semi-solid metal 34 removed during several cycles with a like cumulative amount of molten metal 32 after several casting cycles.

In typical applications vessel 12 contains approximately 1,200 pounds (544.3 kg.) of semi-solid A356 aluminum alloy, while components formed from the semi-solid alloy typically require between five to thirty pounds (5–30 lbs.) (2.27–13.6 kg.) of semi-solid alloy to fabricate. Therefore, less than three percent (3%) by weight of semi-solid metal 34 at 590°–615° C. (1094°–1139° F.) is removed from bath 16 and replaced by molten metal 32 at greater than 615° C. (1139° F.) causing the average temperature of bath 16 to change by much less than one degree Celsius (1° C.) (1.8° F.) during each casting cycle. Even if twenty-five pounds (25 lbs.) (11.34 kg.) of semi-solid metal 34 is replaced by molten metal 32 from source 52, the average temperature of an A356 bath 16 is changed by less than three-tenths degree Celsius (0.3° C.) (0.54° F.).

One method contemplated by the present invention includes providing a die casting press having a mold cavity for receiving the metal to be cast and chilling the metal to a solid form and providing a vessel 12 of molten metal having a bottom wall 36 and a side wall 38. The temperature of molten metal in vessel 12 is lowered to a level at which the metal begins to solidify and then metal is stirred and heated to maintain the metal at an isothermal state containing a controlled percent of solid particles of metal and molten metal. Illustratively, the percent of solid particles is controlled in part by controlling the temperature of the metal within a specified range of a setpoint by circulating semi-solid metal 34 through a heating chamber 24 communicating through bottom wall 36 of vessel 12 and cooling semi-solid metal 34 through side wall 38 of vessel 12.

Controlled amounts 122 of semi-solid metal 34 are withdrawn periodically from vessel 12 and transferred to the mold cavity for casting. The transferring is accomplished so that semi-solid metal 34 maintains its semi-solid state throughout the transferring process. The temperature of the withdrawn semi-solid metal 34 is controlled during the transferring step. While the presently preferred method controls the temperature of the withdrawn semi-solid metal 34 during transfer by providing a temperature controlled suction tube 108 and charge sleeve 116, temperature may be controlled by positioning press and vessel 12 sufficiently adjacent to each other so that withdrawn semi-solid metal 34 may be manually or automatically ladled between vessel 12 and charge sleeve 116 quickly enough to prevent substantial heat loss from the transferred amount 122. As part of the transferring process controlled amount 122 of semi-solid metal 34 is forced under pressure into the mold cavity. The pressure required is on the order of 10,000 psi (1.45 Pa.).

Plunger tip 132 used to press the withdrawn semi-solid metal 84 into the mold cavity is designed to selectively seal charge sleeve 116 to allow vacuum ladling of semi-solid material 34 to the mold prior to pressing, and to break the seal to allow semi-solid metal 34 not in charge sleeve 116 to return to bath 16.

Corresponding controlled amounts 126 of molten metal 32 are periodically added to vessel 12 to replace each withdrawn amount 122 of semi-solid metal 34. Semi-solid metal 34 in vessel 12 is maintained in a stable semi-solid condition with constant stirring and controlled heating. Included among the aspects of controlled heating of semi-solid metal 34 are limiting the quantity of controlled amounts 122 of withdrawn semi-solid metal 34 so that the withdrawn amount does not exceed a specified percentage of the total volume of semi-solid metal 34 in vessel 12 and controlling the temperature of molten metal 32 added to replace withdrawn semi-solid metal 34 so that it is only slightly above the liquidation temperature of the metal.

Although the invention has been described in detail with reference to certain preferred embodiments, variations and modifications exist within the scope and spirit of the invention as described and defined in the following claims.

What is claimed is:

1. A method for die casting metal alloy from a source of alloy maintained in a semi-solid state, the method comprising the steps of:

providing a die casting press having a mold cavity for receiving the metal to be cast and chilling the metal to a solid form, providing a vessel of molten metal having a bottom and a side, providing a heater thermally communicating with only the bottom of the vessel, lowering the temperature of the molten metal to a level at which the metal will begin to solidify, stirring the metal and controlling the temperature to maintain the metal at an isothermal state containing solid particles of metal and molten metal, wherein controlling the temperature is accomplished by heating through the bottom of the vessel and wherein cooling of the metal is in part through the side of the vessel, and wherein the stirring includes shearing of solidifying metal from the sides of the vessel, whereby the metal in the vessel is maintained in a stable semi-solid condition with constant stirring and temperature control.

2. The method of claim 1 and further comprising the step of periodically withdrawing controlled amounts of metal from the vessel and transferring the metal to the mold cavity for casting through a suction tube.

3. The method of claim 2 and further comprising the step of controlling the temperature of the withdrawn metal during the transferring step.

4. The method of claim 2 and further comprising the step of periodically adding corresponding controlled amounts of molten metal to the vessel to replace each, withdrawn amount of metal.

5. The method of claim 4 and further comprising the step of controlling the temperature of the withdrawn metal during the transferring step.

6. The method of claim 2 and further comprising the step of allowing metal suspended in the suction tube to return to the bath during casting of a component.

* * * * *